US006240668B1

(12) United States Patent
Clawson et al.

(10) Patent No.: US 6,240,668 B1
(45) **Date of Patent: *Jun. 5, 2001**

(54) APPARATUS TO DISTINGUISH CONTAINERS

(75) Inventors: Burrell E. Clawson, Newport Beach, CA (US); James Weigl, Las Vegas, NV (US)

(73) Assignee: Pharcon Corporation, Las Vegas, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/995,571

(22) Filed: Dec. 22, 1997

(51) Int. Cl.[7] ..... G09F 9/40
(52) U.S. Cl. ..... 40/665; 40/661.05; 40/306
(58) Field of Search ..... 40/229.01, 306, 40/310, 661.05, 665

(56) References Cited

U.S. PATENT DOCUMENTS

| | | | | |
|---|---|---|---|---|
| 110,760 | * | 1/1871 | Harrison | 40/310 |
| 763,128 | * | 6/1904 | Trumpour | 40/310 |
| 1,032,610 | * | 7/1912 | Kern | 40/310 |
| 1,036,588 | * | 8/1912 | Eastburn | 40/665 |
| 1,238,551 | * | 8/1917 | Merklee et al. | 40/306 |
| 1,761,995 | * | 6/1930 | Siebe | 40/306 |
| 3,586,220 | * | 6/1971 | Reinsberg | 224/28 |
| 3,599,362 | * | 8/1971 | Klober | 40/306 |
| 4,278,167 | * | 7/1981 | Van Rossem | 206/45.34 |
| 4,860,684 | * | 8/1989 | Al-Harbi | 40/310 |
| 4,895,257 | * | 1/1990 | Winslow | 40/310 |
| 4,951,596 | * | 8/1990 | Wallace, Jr. | 40/310 |
| 4,979,325 | * | 12/1990 | White | 40/310 |
| 5,390,964 | * | 2/1995 | Gray, Jr. | 40/306 |
| 5,403,636 | * | 4/1995 | Crum | 428/40 |
| 5,448,844 | * | 9/1995 | Miller, Jr. et al. | 40/306 |
| 5,922,422 | * | 7/1999 | Otruba | 428/34.1 |

* cited by examiner

*Primary Examiner*—Anthony Knight
*Assistant Examiner*—Mark Williams
(74) *Attorney, Agent, or Firm*—Stout, Uxa, Buyan & Mullins, LLP; Frank J. Uxa

(57) ABSTRACT

An apparatus to facilitate identifying a container, for example, a pharmaceutical container, includes at least one member adapted to be secured, for example, removably secured, to a container and to provide indication information effective to distinguish the container when the member is secured thereto, for example, relative to an identical container without the member. The present apparatus is particularly useful in facilitating distinguishing one pharmaceutical container from one or more other pharmaceutical containers.

31 Claims, 3 Drawing Sheets

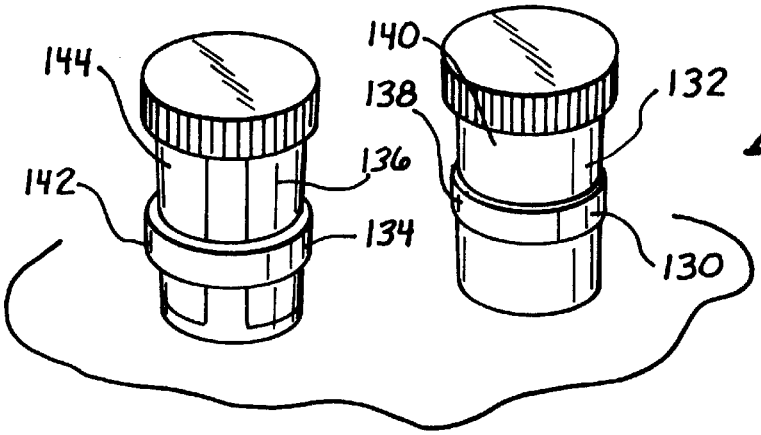
Fig. 5
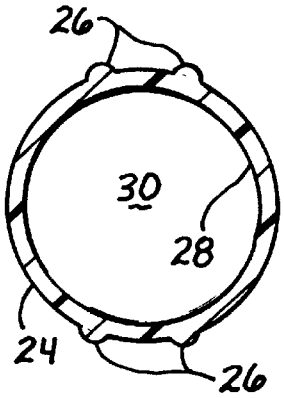
Fig. 6
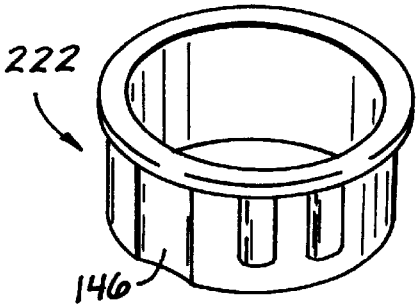
Fig. 7
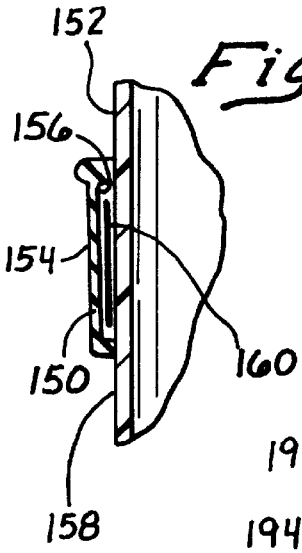
Fig. 9
Fig 8
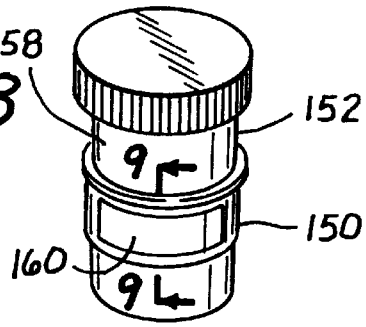
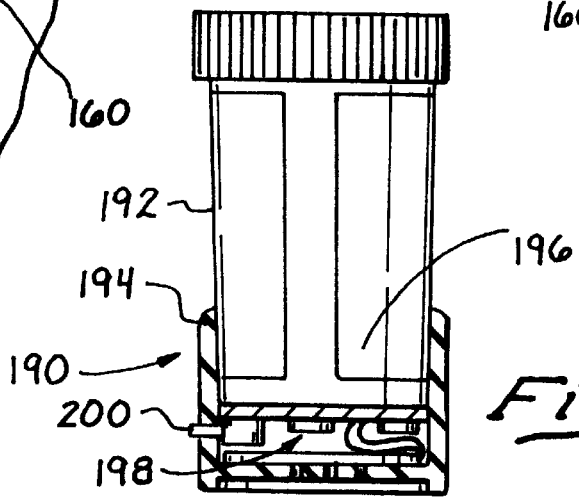
Fig. 11

APPARATUS TO DISTINGUISH CONTAINERS

BACKGROUND OF THE INVENTION

The present invention relates to apparatus to facilitate identifying containers. More particularly, the invention relates to apparatus adapted to be secured to containers, for example, pharmaceutical containers, to distinguish the containers from other containers, e.g., identical containers, without the apparatus.

Pharmaceuticals are an important and beneficial development of modern life. Humans often take or ingest more than one pharmaceutical to treat different conditions. It is important that the correct pharmaceutical be selected, from the plurality of pharmaceuticals in the user's possession, to treat a specific condition. Taking a wrong or incompatible medication, for example, in the event of an acute attack, such as an asthma attack, can result in substantial detriment to, or even the death of, the user.

Pharmaceutical containers are frequently of the same size even though they contain quite different, and even incompatible, medications. Pharmaceutical containers often contain detailed written labels which are adhered or glued to the container prior to being provided to the user. Such labels identify, in detail, the pharmaceutical included in the container, the frequency of use, and, possibly, when such pharmaceutical is to be avoided. The glued on labels, noted above, clearly distinguish the pharmaceutical in one container from the pharmaceuticals in other containers.

However, there are circumstances which may prevent such glued on labels from providing information to distinguish one container from other containers. For example, in emergency situations, in the event of an acute attack, for example, such an attack which impairs the user, or in the event the user is visually impaired and/or in an unlighted environment, among other situations, the information on the glued on label may be inadequate to distinguish the containers.

It would be advantageous to provide a system for easily and rapidly distinguishing between containers, for example, pharmaceutical containers, even in situations where it is difficult, or even impossible, to read information from labels which are adhered to or glued on the containers.

SUMMARY OF THE INVENTION

Apparatus to facilitate identifying a container, for example, a pharmaceutical container, have been discovered. The present invention provides for very quick, reliable and effective identification of a particular container relative to one or more other identical containers. The present apparatus is preferably other than a pre-existing label, that is other than a label adhered to, or glued or otherwise placed on the container prior to providing the container to the user. The container is provided with a very straightforward, easy to use and easy to recognize system to identify or distinguish individual containers, preferably without reading or even referring to the above-noted labels. Ultimately, the user of the pharmaceutical in the container is provided with an increased degree of comfort that the medication he or she is ingesting is the correct medication. Moreover, simply by allowing the user of a pharmaceutical to personally identify or distinguish the pharmaceutical containers he or she is using, for example, the container or containers including critically important medications, beneficially gives the user an increased sense of control and independence over the treatment of his or her conditions.

In one aspect, the present invention is directed to apparatus to facilitate identifying pharmaceutical containers. Such apparatus comprise at least one member adapted, and preferably sized, to be secured, for example, removably secured, to a pharmaceutical container, preferably other than adhesively. The member provides indication information effective to distinguish the pharmaceutical container when the member is secured thereto, preferably relative to an identical container without the member. Thus, the user of the pharmaceutical included in the container can secure the member or members on the container, for example, after having purchased or otherwise been provided with the pharmaceutical in the container. In so doing, the user has clearly distinguished this container, for example, relative to an identical container which does not have the same member or members secured to it.

In one embodiment, the member or members are adapted to be permanently secured to the pharmaceutical container, for example, by the pharmacist prior to providing the container to the user of the pharmaceutical. Such member or members, for example, located on the bottom of the container, such as a mating cup-like member, provide indication information to allow a positive identification of the contents inside the container other than by reading the conventional or original label affixed to the container, for example, by the pharmacist. Such member or members could, for instance, have tactile indication information and/or visual, e.g., color, indication information and/or audible indication information, such as from a user-activated sound making or synthesized speech device to audibly announce the indication information.

In a further aspect of the present invention, the apparatus comprises at least two members adapted to be secured to a pharmaceutical container and, together, to provide indication information effective to distinguish the pharmaceutical container when the members are secured thereto, preferably relative to an identical container without the members attached thereto.

Preferably, the member or members are further adapted to be removed from one container and reused by being secured to a different pharmaceutical container to distinguish the different pharmaceutical container, for example, relative to an identical container without the member or members.

The indication information provided by the member or members in accordance with the present invention may be any one or more pieces or bits of information which is recognizable by the user of the container as distinguishing that container from one or more other containers. Among the types of indication information that may be used are visual indication information, that is information that is recognized using the sense of sight, tactile indication information, that is information that is recognized using the sense of feel or touch, audible indication information, that is information that is recognized using the sense of hearing, smell indication information, that is information that is recognized using the sense of smell, and combinations thereof. Each of these types of indication information include many, many examples, all of which are included within the scope of the present invention.

To illustrate, visual indication information can involve, among other visually recognizable factors, color, transparency/opaqueness, visually recognized marking or markings and shapes and the like. Tactile indication information can involve, among other tactilely recognizable factors, texture, other surface features or structures, marking or markings which may not be completely or accurately visually recognizable and the like. Audible indication information can involve, among other audibly recognizable factors, mechanically created sound, electronically created sound, user activated sound, synthetically produced voice sounds and the like. Smell indication information can involve, among other smell recognizable factors, perfumed or otherwise scented members, "scratch and sniff" members and the like.

In one preferred embodiment, the indication information is recognizable by at least two, that is, two or more, senses. For example, the member used can have a specific color (visually recognizable), have a specific shape (tactically recognizable), be adapted to be rubbed against a surface to make a specific sound (audibly recognizable), and be made of a polymer including a specific fragrance (smell recognizable). Many forms of indication information are susceptible to "two sense", e.g., visual and tactile, recognition. For example, size indication information and number, e.g., the number of members secured to any specific container, indication information, surface feature or structure indication information and configuration or shape indication information, are among the forms of indication information that may be recognized by at least two senses.

Indication information recognizable by at least two senses provides substantial advantages. Such information allows the user to make two separate and independent determinations as to the identity of the container so that the comfort level of the user is increased. However, there are circumstances in which only a single sense can be used to identify the container. For example, the user may be physically impaired. The member or members secured to the container can provide two different and distinct pieces of indication information recognized by the same sense, for example, the sense of feel. Thus, the user can make two separate and independent determinations of the container identity and is given an increased degree of comfort that the correct pharmaceutical has been selected even though he or she is visually impaired or is in an unlighted environment.

Preferably, the at least one member is translucent or transparent. This feature facilitates being able to read the information on the glued on label. In one particularly useful embodiment, the pharmaceutical container includes an outer peripheral surface and the at least one member is adapted, when secured to the pharmaceutical container, to circumscribe at least a portion of the outer peripheral surface. A set of members may be provided which are distinguished one from the other by the extent to which the individual members circumscribe the outer peripheral surface of the container. For example, one member can be configured to only partially circumscribe the outer peripheral surface, whereas other members of the set can be adapted to circumscribe the outer peripheral surface of the container more than once, for example, one and a half, two and a half, three and a half, etc., times, in a spiral-like configuration. The extent to which each member circumscribes the outer peripheral surface of the container is indication information which is both visually and tactilely recognizable.

In one embodiment, the present apparatus comprises a member which includes an outer peripheral wall, an opposing inner peripheral wall and an insertable information carrying device including at least a portion of the identification information. The insertable device is adapted to be held between the inner peripheral wall of the member and the pharmaceutical container, for example, the outer peripheral surface of the container, when the member is secured to the container. This insertable device can include one or more markings, for example, placed on the device by the user of the pharmaceutical, which is recognized by the user as identifying the particular pharmaceutical container. Thus, using this embodiment, the pharmaceutical user clearly marks the insertable device to identify the specific pharmaceutical container and then places the device on the pharmaceutical container by placing the member on the container.

The present apparatus can be provided as a single member, two or more members or a set of different members. In one embodiment, the apparatus comprises a set of members, for example, the same or different members. Each member or a combination of two or more members is adapted to be secured to a different one of a plurality of containers and to provide different indication information effective to distinguish the container when the member or members are secured thereto from each of the other containers of the plurality of containers.

The present member or members can be substantially rigid and made from any suitable material. Although other materials, such as paper, metal, glass, wood and the like, may be used, the member or members preferably are made of polymeric material, for example, thermoplastic polymeric materials. In the event the member only partially circumscribes the container or circumscribes the container more than once, for example, in the form of a spiral, metal is a preferred material of construction. Polyolefins, such as polyethylene, is one specific example of a useful material of constriction. The member or members, in one embodiment, are adapted to be removably secured to the container or containers. The member or members preferably are adapted and sized to fit substantially snugly around at least a portion of the outer peripheral surface of the container or containers. Such snug fit or securement preferably is such that the member or members can be manually removed from the container or containers without destroying, or significantly damaging, either the member or members or the container or containers.

In a particularly useful embodiment, the member or members have substantial elasticity. Such elasticity is beneficial in that the member or members can be secured to containers of somewhat varying sizes. Also, the elasticity advantageously is effective in securing the member or members to the containers.

In an embodiment in which a set of members is provided, it is preferred that the apparatus further comprise a package adapted to contain the set of members apart from the plurality of containers. Thus, the user of pharmaceuticals can separately purchase the members and secure one or more of these members on each of the pharmaceutical containers he or she uses to identify each of the pharmaceutical containers and distinguish them one from the other.

Allowing the individual pharmaceutical user to specifically identify and distinguish each pharmaceutical container he or she uses is an important advantage of the present invention. The user is given an increased degree of comfort that he or she is taking the correct pharmaceutical. In addition, the user is provided with an increased sense of control or independence over the treatment of his or her health conditions/problems.

Each of the features disclosed herein can be used alone and in combination with one or more other such features. Each such feature and combination is within the scope of the present invention.

These and other aspects and advantages of the present invention are apparent in the following detailed description and claims, particularly in conjunction with the accompanying drawings in which like parts bear like reference numerals.

BRIEF DESCRIPTION OF THE DRAWINGS

FIG. 5 is a perspective illustration showing two pharmaceutical containers with additional members in accordance with the present invention.

FIG. 6 is a cross-sectional view taken generally along line 6—6 of FIG. 1.

FIG. 7 is a perspective illustration of an alternate embodiment of an identifying member in accordance with the present invention.

FIG. 8 is a perspective illustration showing a pharmaceutical container with a still further identifying member in accordance with the present invention.

FIG. 9 is a cross-sectional view taken generally along line 9—9 of FIG. 8

FIG. 11 is a plan view, partly in cross-section, showing a pharmaceutical container with yet another identifying member in accordance with the present invention.

DETAILED DESCRIPTION OF THE DRAWINGS

Figure 1:
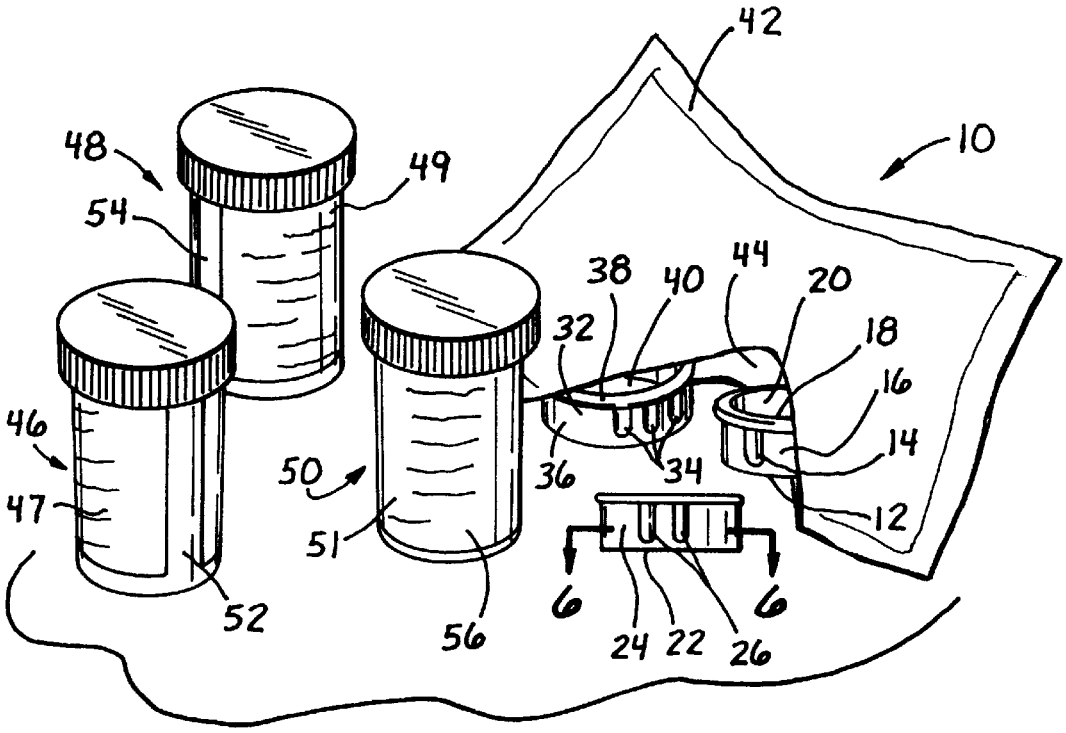
FIG. 1 is a perspective illustration showing a package of identifying members in accordance with the present invention.

Referring now to the drawings, FIG. 1 illustrates a package 10 including a set of three identifying members. Except as expressly described herein, the three members are identical. The first identifying member 12 includes a single projection 14 extending outwardly from the outer peripheral surface 16 of the first member. A similar single projection extends outwardly from the outer peripheral surface 16 of the first member 12 one hundred eighty (180) degrees separated from the projection 14 shown in FIG. 1. First member 12 includes an inner peripheral surface 18 which defines a hollow through space 20.

With reference to both FIGS. 1 and 6, second member 22 includes an outer peripheral surface 24, two projections 26 located together and extending outwardly from the outer peripheral surface and a similar set two projections extending outwardly from the outer peripheral surface and located together one hundred eighty (180) degrees opposite the first set of two projections. Second member includes an inner peripheral surface 28 defining a hollow through space 30.

Third member 32 includes three projections 34 located together and extending outwardly from outer peripheral surface 36 and a similar set of three projections extending outwardly from the outer peripheral surface located together one hundred eighty (180) degrees from the three projections 34 shown in FIG. 1. Third member 32 includes an inner peripheral surface 38 which defines a hollow through space 40.

Each of the first, second and third members, 12, 22 and 32, is made of a thermoplastic polymeric material, for example, polyethylene or the like material. The members 12, 22 and 32 can be made using conventional polymer processing techniques, for example, injection molding or the like. Each of the members 12, 22 and 32 has a substantial degree of elasticity. Substantially the only difference between the first, second and third members, 12, 22 and 32, is the number of projections, as indicated above.

The packaging 42 may be made of any suitable material, for example, polymeric material, and includes a hollow space 44 sufficiently large to hold the first, second and third identifying members 12, 22 and 32 for shipment. The packaging 42 is sealed for shipment and storage of first, second and third members 12, 22 and 32.

When it is desired to use first, second and third identifying members 12, 22 and 32, the packaging 42 is opened and each of the members is placed on a different pharmaceutical container.

As shown in FIG. 1, three pharmaceutical containers 46, 48 and 50 of identical construction are shown. The only difference between containers 46, 48 and 50 are that each of the containers holds a different pharmaceutical and has a different glued on label 47, 49 and 51 (describing the particular pharmaceutical being held by the container) which is provided prior to the containers being given to the user.

In general, each of the pharmaceutical containers described hereinafter is identical in construction and has similar differences, one from the other, as those described in regard to containers 46, 48 and 50.

One of the identifying members 12, 22 and 32 is placed on the outer peripheral wall 52, 54 and 56 of each of the containers 46, 48 and 50. The inner peripheral surface 18, 28 and 38 of each of the members 12, 22 and 32 contact the wall 52, 54 and 56 of the container 46, 48 and 50. The members 12, 22, 32, are sized and have sufficient elasticity so as to remain secured to the respective containers 46, 48 and 50.

The user correlates, and preferably commits to memory, that the pharmaceutical in container 46 is identified by single projections 14 of first identifying member 12. Similarly the pharmaceuticals in containers 48 and 50 are identified by the two projections 26 and three projections 34 of second member 22 and third member 32, respectively. When it is desired to ingest the medication from pharmaceutical container 48, the user need not read the information on the glued on label. Instead, the user merely takes container 48 in his or her hand and feels how many projections are on second member 22. Since the user of the medication has placed member 22 on container 48, he or she recognizes that the presence of two projections 26 on either side of member 22 clearly identifies container 48 and distinguishes container 48 from containers 46 and 50. The user of the medication in container 48 then ingests this medication with absolute confidence that he or she has chosen the correct medication.

Alternately, or in addition, the user can visually compare the containers 46, 48 and 50 and see that one of the containers includes two projections on either side of the secured member. Since the user associates these two projections with container 48, he or she proceeds to take the medication from this container. Thus, the user can use his or her sense of feel and/or sense of sight to "read" the identification information provided by first, second, and third identifying members 12, 22 and 32.

If it is desired to place one or more of first, second and third identifying members 12, 22 and 32 on another pharmaceutical container or containers, such member or members are simply removed from the container or containers 46, 48 and 50 and placed on the other container or containers.

Figure 2:
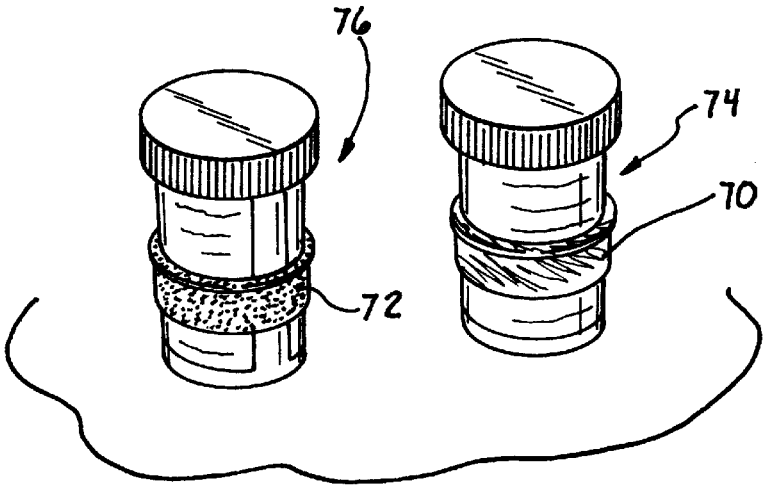
FIG. 2 is a perspective illustration showing two pharmaceutical containers with two other identifying members in accordance with the present invention.

FIG. 2 provides an illustration of another embodiment of the present invention. Two other identifying members 70 and 72 are shown removably secured to pharmaceutical containers 74 and 76, respectively. Except as expressly described, the other identifying members 70 and 72 are constructed similarly to first, second and third identifying members 12, 22 and 32, and containers 74 and 76 are constructed similarly to containers 46, 48 and 50. The other identifying members 70 and 72 include no projections. Members 70 and 72 are identically constructed. The only differences between members 70 and 72 is that member 70 is pink in color and gives off a distinctive flowery fragrance and member 72 is blue in color and gives off a distinctive vanilla fragrance. The colors and fragrances can be provided using conventional techniques, for example, by including the appropriate dyes and concentrated fragrances in the polymer mixes before the members 70 and 72 are formed.

With these two differences, the other identifying members 70 and 72 are placed on containers 74 and 76, as shown in FIG. 2, and allow the user of the different medications in these containers to clearly identify each container and distinguish one from the other by visually comparing the colors of members 70 and 72 and/or by comparatively smelling the fragrances of members 70 and 72.

Figure 3:
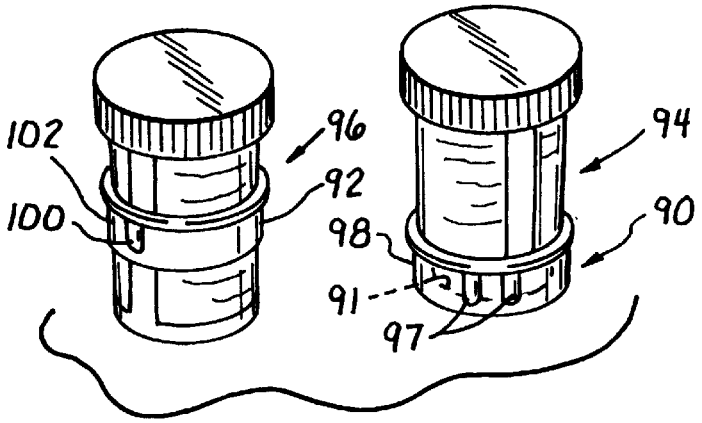
FIG. 3 is a perspective illustration showing two pharmaceutical containers with two further identifying members in accordance with the present invention.

FIG. 3 illustrates a further embodiment of the present invention. Further identifying members 90 and 92 are placed on pharmaceutical containers 94 and 96, respectively. Except as expressly stated herein, further identifying members 90 and 92 are constructed similarly to first identifying member 12 and second identifying member 22, respectively; and containers 94 and 96 are constructed similarly to containers 46, 48 and 50. Further identifying member 90 includes an inwardly extending lip 91 at its bottom to prevent this member from being placed toward the middle of the container 94. Further identifying member 92 has no such lip. In addition, member 90 has two projections 97 extending from its sidewall 98, whereas member 92 has a single projection 100 extending from its sidewall 102.

In this illustration of the present invention, the further member 90 placed on pharmaceutical container 94 distinguishes this pharmaceutical container in two ways from pharmaceutical container 96 on which further member 92 is located. Thus, the location of the member 90 at or near the bottom of pharmaceutical container 94 distinguishes this container 94 from pharmaceutical container 96. Independently, the two projections 97 of member 90 also distinguish pharmaceutical container 94 from pharmaceutical container 96.

Thus, in the embodiment shown in FIG. 3, two independent bases for distinguishing between pharmaceutical containers 94 and 96 are provided. This plurality of bases adds to the comfort of the user of pharmaceutical containers 94 and 96. Both the location indication information and the projection indication information provided by further identifying members 90 and 92 can be recognized or "read" by both sight and feel. This dual recognition feature adds to the flexibility and usefulness of such an embodiment.

Figure 4:
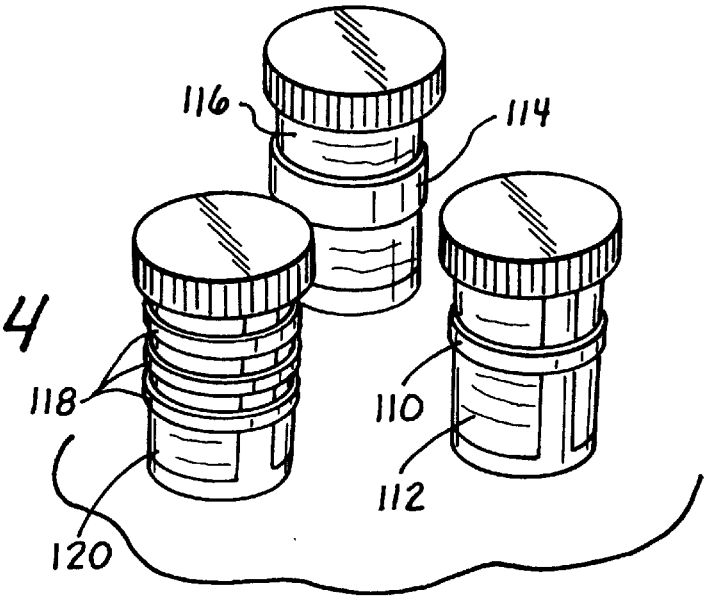
FIG. 4 is a perspective illustration showing three pharmaceutical containers with different identifying members in accordance with the present invention.

FIG. 4 illustrates a different embodiment of the present invention. Different identifying member 110 is shown secured to pharmaceutical container 112, different identifying member 114 is shown secured to pharmaceutical container 116 and three different identifying members 118 are shown secured to pharmaceutical container 120. Each of the members 118 as identically constructed, but is different from member 114. Each of these containers, including the respective member or members described above, are clearly distinguished, using visual and/or tactile recognition, one from the other. For example, member 110 is more narrow than member 114, and there are three members 118 as opposed to the single member 110 and the single member 114. In this way, by seeing or feeling the single narrow member 114, the user of pharmaceutical container 112 can easily distinguish this container from containers 116 and 120. Similarly, the single member 114 secured to container 116, clearly distinguishes that container from container 120 which includes three members 118. Finally, the three members 118 secured to container 120 clearly distinguish this container from the other two containers 112 and 116.

FIG. 5 illustrates an additional embodiment of the present invention. In this embodiment thin identifying member 130 is secured to pharmaceutical container 132, while thick identifying member 134 is secured to pharmaceutical container 136. Members 130 and 134 are made of polymeric material, similar to first member 12, and have substantial elasticity. The structures of member 130 and member 134 are identical except that member 130 is thinner than member 134. The user of these two containers can easily distinguish one from the other simply by feeling the difference in distance between the outer peripheral surface 138 of member 130 and the outer peripheral wall 140 of container 132 relative to the distance between the outer peripheral surface 142 of member 134 and the outer peripheral wall 144 of container 136.

FIG. 7 illustrates an alternate embodiment of second member 22. Except as expressly described herein, the alternate member 222 shown in FIG. 7 is similar to second member 22 shown in FIG. 6. Components of the alternate member 222 which correspond to components of second member 22 are identified by the same reference numeral increased by 200.

The primary difference between member 22 and member 222 is the presence of a thumb index area 146 in member 222. This thumb index area 146 allows the user a quick index or reference (for placing his or her thumb) in feeling for differences between various members, for example, members containing 1, 2 or 3 projections.

FIGS. 8 and 9 illustrate a still further embodiment of the present invention. The still further identifying member 150 is secured around container 152. As shown in FIG. 9, member 150 includes an outer peripheral surface 154 and an inner peripheral surface 156 which extends outwardly away from the outer peripheral wall 158 of container 152. A label 160 is placed in the indent formed by inner peripheral surface 156. This label 160 includes a very simple alpha numeric or other symbol, for example, the letter "A", which is seen through member 150, which is transparent. In this manner, the user of the pharmaceutical container 152 can use the label 160 to very conveniently make a mark to identify container 152 relative to other pharmaceutical containers. Since the user of the pharmaceutical provides the identification information to label 160, he or she clearly remembers the information and feels a sense of comfort, control and independence in treating the condition for which the pharmaceutical is ingested.

In the event the member 150 is to be used on another pharmaceutical container, it is removed from pharmaceutical container 152. The label 160 can also be reused or can be replaced by another similarly sized label having a marking identifying the other container on which it is to be placed. At that point, the label is placed in the indent noted above, and the member 150 is placed on the other pharmaceutical container to identify and distinguish this other container relative to different containers.

Figure 10:
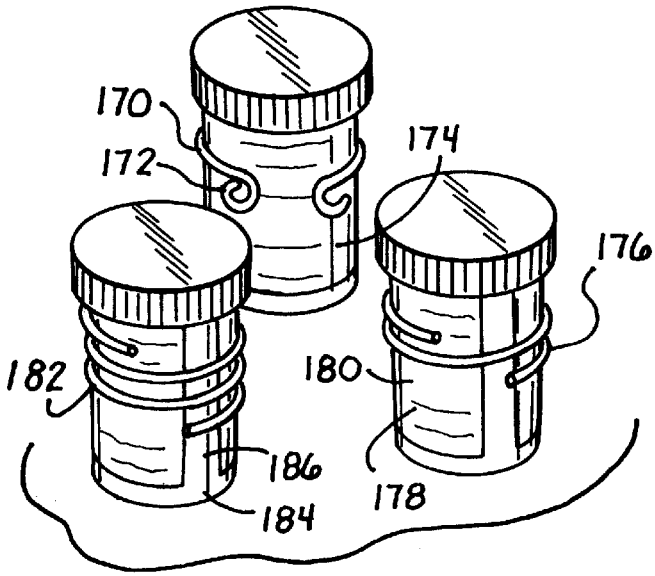
FIG. 10 is a perspective illustration showing three pharmaceutical containers with three alternative identifying members in accordance with the present invention.

FIG. 10 illustrates an alternative embodiment of the present invention. In this embodiment first alternate identifying member 170 is placed on container 172. Member 170 circumscribes only a portion of the outer peripheral surface 174 of container 172. Second alternate identifying member 176 is placed on container 178 and extends in a spiral-like fashion through almost two complete revolutions from the outer peripheral surface 180 of container 178. Third alternate identifying member 182 is placed on container 184 and extends in a spiral-like fashion almost three times around the outer peripheral surface 186 of container 184. Each of members 170, 176 and 182 is made of metal, for example, steel. The number of times or portions of times the members 170, 176 and 182 circumscribe the containers 172, 178 and 184 can be seen and/or felt and used as a basis for distinguishing containers 172, 178 and 184 from one another.

FIG. 11 illustrates yet another embodiment of the present invention. In this embodiment, yet another identifying member, shown generally at 190, is placed on container 192. Specifically, cup member 194 of member 190 is sized and adapted to receive and hold the bottom portion 196 of container 192. For example, member 190 can be permanently secured to container 192 by a pharmacist prior to providing the pharmaceutical contained in container 192 to the user. In addition, member 190 includes a sound device, shown generally at 198. Sound device 198, which may be conventionally structured, is adapted, when activated, to make an audible signal which can be heard and recognized by the user as identifying the pharmaceutical included in container 192. Sound device 198 includes a switch 200 which extends outwardly and can be activated by the user when the user desires to identify container 192.

Thus, when the user is scheduled to take the pharmaceutical included in container 192, he or she merely presses switch 200 which causes member 190, and in particular, sound device 198, to make an audible sound which can be used to identify this container. The user then has the comfort of knowing that the medication he or she is taking is the correct pharmaceutical.

The above descriptions merely illustrate certain the embodiments of the present invention and are not intended to limit the broad scope of the invention. It should be noted that many other variations and additional schemes by which pharmaceutical containers can be distinguished one from the other are included within the scope of the present invention. One important consideration in the present invention is that the pharmaceutical container have secured to it a member which is recognizable by one or more senses of the user of the pharmaceutical to distinguish that container from other containers.

While this invention has been described with respect to various specific examples and embodiments, it is to be understood that the invention is not limited thereto and that it can be variously practiced within the scope of the following claims.

What is claimed is:

1. An apparatus to facilitate identifying a pharmaceutical container, the apparatus comprising:

at least one substantially elastic member sized and adapted to be removably secured on an outer peripheral surface of a pharmaceutical container other than adhesively and, when so secured to a pharmaceutical container, to completely circumscribe an outer peripheral surface of the pharmaceutical container, said at least one member including indication information effective to distinguish a pharmaceutical container when the at least one member is so secured relative to an indentical container having a different at least one member attached thereto, the at least one member being translucent or transparent.

2. The apparatus of claim 1 wherein the at least one member is further adapted to be reused by being secured to a different pharmaceutical container to distinguish the different pharmaceutical container when the at least one member is so secured.

3. The apparatus of claim 1 wherein the at least one member is structured so that the indication information is recognizable by least two senses of a human capable of using the at least two senses to recognizes the indication information.

4. The apparatus of claim 1 wherein the indication information provided is selected from the group consisting of visual indication information, tactile indication information, audible indication information, smell indication information and combinations thereof.

5. The apparatus of claim 1 which comprises more than one of the members sized and adapted to be secured to a pharmaceutical container.

6. The apparatus of claim 1 wherein the at least one member is sized and adapted, when secured to a pharmaceutical container having an outer peripheral surface, to circumscribe the outer peripheral surface more than one time.

7. The apparatus of claim 1, wherein the at least one member includes only a single, unitary substantially elastic member.

8. The apparatus of claim 1 wherein the at least one member includes an outer peripheral wall and an opposing inner peripheral wall and the apparatus further comprises an insertable information carrying device including additional indication information, the insertable information carrying device being sized and adapted to be held between the inner peripheral wall and a pharmaceutical container when the member is secured to the pharmaceutical container.

9. The apparatus of claim 1 which further comprises a pharmaceutical container with the at least one member secured thereto.

10. The apparatus of claim 1 wherein the indication information provided is selected from the group consisting of tactile indication information, audible indication information, smell indication information and combinations thereof.

11. An apparatus to facilitate identifying a pharmaceutical container including an outer peripheral surface, the apparatus comprising:

at least one substantially elastic member sized and adapted to be removably secured on an outer peripheral surface of a pharmaceutical container by a user of the pharmaceutical container to completely circumscribe the outer peripheral surface and to provide indication information recognizable by at least two senses of a human capable of using the at least two senses to recognize the indication information, the indication information being effective to distinguish a pharmaceutical container when the at least one member is so secured relative to an identical container with a different at least one member attached thereto, the at least one member having sufficient elasticity to be securable on outer peripheral surfaces of pharmaceutical containers having outer diameters of varying sizes.

12. The apparatus of claim 11 wherein the at least one member is further adapted to be reused by being secured to a different pharmaceutical container to distinguish a different pharmaceutical container when the at least one member is so secured.

13. The apparatus of claim 11 wherein the indication information provided includes information selected from the group consisting of visual indication information, tactile indication information, audible information, smell information and combinations thereof.

14. The apparatus of claim 11 which further comprises a pharmaceutical container with the at least one member secured thereto.

15. An apparatus to facilitate identifying a pharmaceutical container, the apparatus comprising:

at least one substantially elastic member sized and adapted to completely circumscribe and be secured on an outer peripheral surface of a pharmaceutical container and including indication information effective to distinguish a pharmaceutical container when the member is so secured relative to an identical container having a different at least one member attached thereto, the at least one member being translucent or transparent and is other than a label placed on a pharmaceutical container prior to the pharmaceutical container being provided to a user of a pharmaceutical in the pharmaceutical container.

16. The apparatus of claim 15 wherein the indication information is recognizable by at least two senses of a human capable of using the at least two senses to recognize the indication information.

17. The apparatus of claim 15 wherein the indication information provided is selected from the group consisting of visual indication information, tactile indication information, audible indication information, smell indication information and combinations thereof.

18. The apparatus of claim 15 which comprises more than one of the members sized and adapted to be secured on an outer peripheral surface of a pharmaceutical container.

19. The apparatus of claim 15 which further comprises, a pharmaceutical container with the at least one member secured on an outer peripheral surface of the pharmaceutical container.

20. An apparatus to facilitate identifying each of a plurality of containers, the apparatus comprising:

a set of substantially elastic members, each member or a combination of two or more members being sized and adapted to be removably secured on and to completely circumscribe an outer peripheral surface of a different one of a plurality of containers, each member or combination of members including different indication information effective to distinguish one of the plurality of containers when the member or members are secured to it from each of other containers of a plurality of containers each having a different member or a different combination of two or more members secured thereto, each of the members having sufficient elasticity to be securable to containers having outer diameters of varying sizes.

21. The apparatus of claim 20 which further comprises a package containing said set of members apart from a plurality of containers, each of the members is different from the other members, and each of the members is translucent or transparent.

22. The apparatus of claim 20 wherein the indication information provided is selected from the group consisting of visual indication information, tactile indication information, audible indication information, smell indication information and combinations thereof.

23. The apparatus of claim 20 wherein the indication information is recongnizable by at least two senses of a human capable of using the at least two senses to recognize the indication information.

24. The apparatus of claim 1 wherein the at least one member has sufficient elasticity to be securable on outer peripheral surfaces of pharmaceutical containers having outer diameters of varying sizes.

25. The apparatus of claim 20 wherein the indication information provided is selected from the group consisting of tactile indication information, audible indication information, smell indication information and combinations thereof.

26. An apparatus to facilitate distinguishing a pharmaceutical container, the apparatus comprising:

a single, unitary, substantially elastic member sized and adapted to be removably secured on and to completely circumscribe an outer peripheral surface of a pharmaceutical container and to provide indication information effective to distinguish a pharmaceutical container when the member is so secured relative to an identical container having a different single, unitary member attached thereto, the member having sufficient elasticity to be securable on outer peripheral surfaces of pharmaceutical containers having outer diameters of varying sizes.

27. The apparatus of claim 26 wherein the indication information provided is selected from the group consisting of visual indication information, tactile indication information, audible indication information, smell indication information and combinations thereof.

28. The apparatus of claim 26 which further comprises a pharmaceutical container with the member secured on an outer peripheral surface of the pharmaceutical container.

29. The apparatus of claim 26 wherein the member is translucent or transparent.

30. The apparatus of claim 26 wherein the member is structured to provide that the indication information is recognizable by at least two senses of a human capable of using the at least two senses to recognize the indication information.

31. The apparatus of claim 26 wherein the indication information provided is selected from the group consisting of tactile indication information, audible indication information, smell indication information and combinations thereof.

* * * * *